United States Patent [19]

Jereb

[11] 3,998,198

[45] Dec. 21, 1976

[54] CAPACITOR DISCHARGE IGNITION SYSTEM WITH FREQUENCY OPERATED SPEED LIMITING CONTROL

[75] Inventor: Richard F. Jereb, Lindenhurst, Ill.

[73] Assignee: Outboard Marine Corporation, Waukegan, Ill.

[22] Filed: Apr. 21, 1975

[21] Appl. No.: 570,033

[52] U.S. Cl. ..... 123/148 CC; 123/118

[51] Int. Cl.[2] ..... F02P 1/00

[58] Field of Search ..... 123/148 CC, 118

[56] References Cited

UNITED STATES PATENTS

| | | | |
|---|---|---|---|
| 3,500,809 | 3/1970 | Hohne | 123/118 |
| 3,703,889 | 11/1972 | Bodig | 123/148 MC |
| 3,809,043 | 5/1974 | Nagasawa | 123/148 MC |
| 3,863,616 | 2/1975 | Wood | 123/118 |
| 3,875,915 | 8/1975 | Anderson | 123/118 |

*Primary Examiner*—Charles J. Myhre
*Assistant Examiner*—Ronald B. Cox
*Attorney, Agent, or Firm*—Michael, Best & Friedrich

[57] ABSTRACT

Disclosed herein is a capacitor discharge ignition system with speed-limiting capability, which system comprises a charge capacitor, a coil, a magnet rotatable relative to the coil for generating alternating potential in the coil, a rectifier connected between the coil and capacitor for rectifying the alternating potential to a potential of one polarity and for applying the potential of one polarity ot charge the capacitor, a first switch connected to the capacitor for discharging the capacitor to generate a spark in response to the application of a first trigger signal, a second switch connected to the capacitor for preventing charging of the capacitor in response to the application of a second trigger signal above a predetermined potential, and a signal generating circuit connected to the second switch and operative to generate the second trigger signal in response to rotation above a predetermined speed of the magnet, which second signal generating circuit includes a transformer connected to the coil.

15 Claims, 1 Drawing Figure

Figure 1:
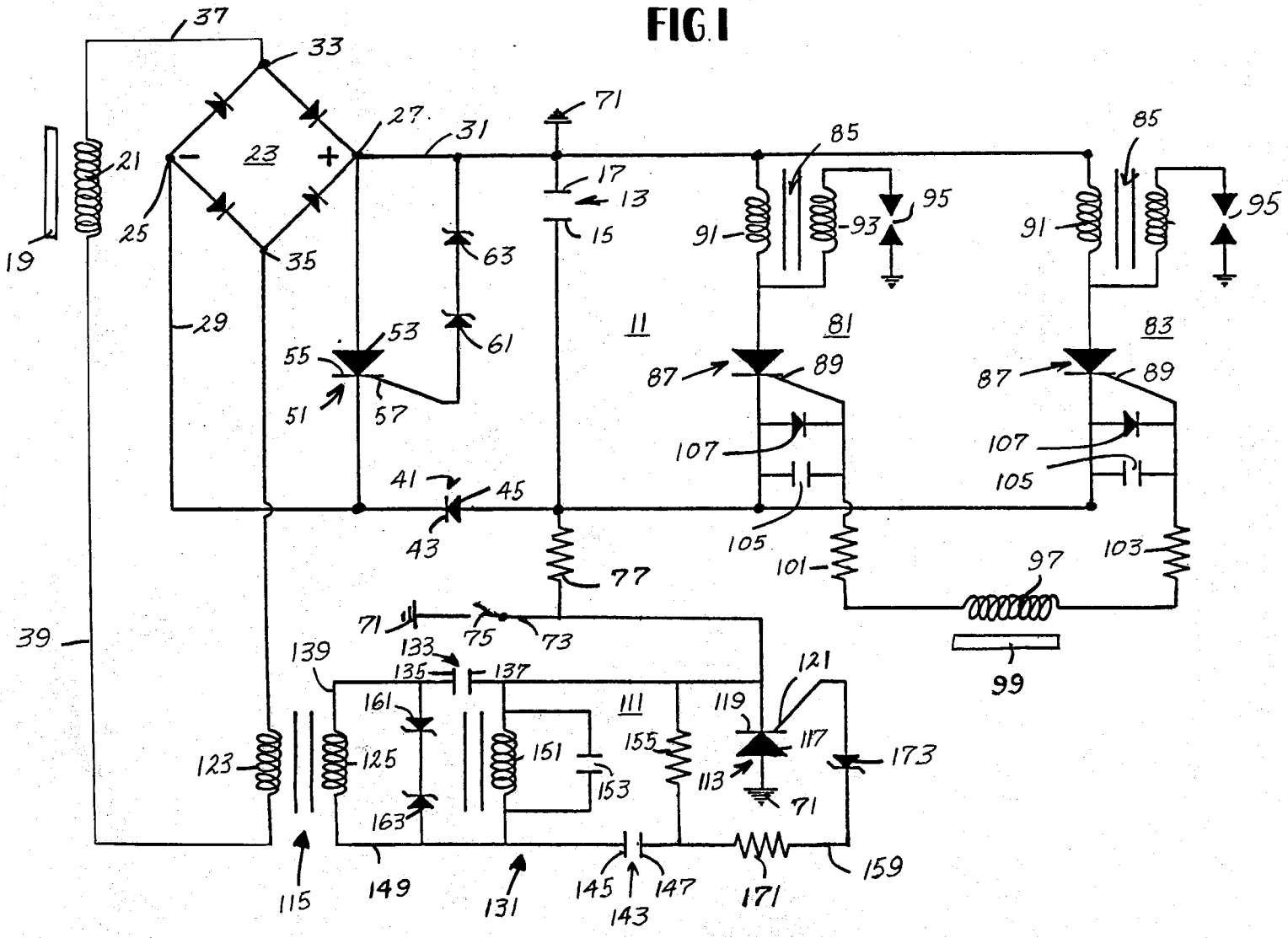

CAPACITOR DISCHARGE IGNITION SYSTEM WITH FREQUENCY OPERATED SPEED LIMITING CONTROL

BACKGROUND OF THE INVENTION

The invention relates generally to ignition circuits or systems and, more particularly, to capacitor discharge ignition circuits or systems.

The invention also relates to capacitor discharge ignition systems including means for preventing overspeed engine operation.

Attention is directed to the following United States Patents:

| | | |
|---|---|---|
| Chavis | 3,430,615 | March 4, 1969 |
| Minks | 3,534,719 | October 20, 1970 |
| Bodig | 3,703,889 | November 28, 1972 |
| Jereb | 3,809,044 | May 7, 1974 |
| Wood | 3,863,616 | February 4, 1974 |
| Anderson | 3,875,915 | April 8, 1975 |

SUMMARY OF THE INVENTION

The invention provides a capacitor discharge ignition system with speed-limiting capability, which system comprises a charge capacitor, relatively rotatable magnet and coil means for generating alternating potential, means connected between the means for generating alternating potential and the capacitor for rectifying the alternating potential to a potential of one polarity and for applying the potential of one polarity to charge the capacitor, first switch means connected to the capacitor for discharging the capacitor to generate a spark in response to the application of a first trigger signal, second switch means connected to the capacitor for preventing charging of the capacitor in response to the application of a second trigger signal above a predetermined potential, and a signal generating circuit connected to the second switch means and operative to generate the second trigger signal in response to rotation above a predetermined speed of the means for generating alternating potential, which second signal generating circuit includes a transformer connected to the means for generating alternating potential.

In accordance with one embodiment of the invention, the capacitor includes opposed first and second plates, the first plate is grounded, the transformer includes a primary coil connected to the means for generating alternating current and a secondary coil, the second switch means comprises an SCR having a gate, an annode connected to ground, and a cathode connected to the second plate of the capacitor, and the signal generating circuit further includes a filter connected between the secondary coil and the SCR.

In accordance with an embodiment of the invention, the secondary coil includes opposed first and second ends, the filter includes a first capacitor including a first plate connected to the first end of the secondary coil, and a second plate connected to the SCR cathode, a second capacitor including a first plate connected to the second end of the secondary coil and a second plate connected to the SCR gate, and an inductor connected between the second plate of the first capacitor and the first plate of the second capacitor.

In accordance with an embodiment of the invention, the filter further includes another capacitor connected across the inductor and a resistor connected between the second plate of the first capacitor and the second plate of the second capacitor.

In accordance with an embodiment of the invention, the second plate of the second capacitor is connected to the gate by a lead including, in series, a resistor and a zenor diode including an annode connected to the gate and a cathode connected to the resistor.

In accordance with an embodiment of the invention there is also provided means for regulating the output of the secondary coil including a pair of cathode-to-cathode series connected, zenor diodes connected across the secondary coil.

One of the principal features of the invention is a provision of a capacitor discharge ignition system with a speed-limiting sub-circuit which includes a transformer connected to relative rotatable magnet and coil means for charging the capacitor, together with a filter connected between the transformer and a switch which, when turned on by a signal generated by the transformer and processed through the filter, is operative to prevent charging of the capacitor in response to overspeed engine operation.

Other features and advantages of the embodiments of the invention will become known by reference to the following general description, claims, and appended drawing.

DRAWINGS

FIG. 1 is a wiring diagram of a capacitor discharge ignition system incorporating various of the features of the invention.

Before explaining the embodiments of the invention in detail, it is to be understood that the invention is not limited in its application to the details of construction and the arrangement of the components set forth in the following description or illustrated in the drawing. The invention is capable of other embodiments and of being practiced and carried out in various ways. Also it is to be understood that the phraseology and terminology employed herein is for the purpose of description and should not be regarded as limiting.

GENERAL DESCRIPTION

Shown in FIG. 1 of the drawings is a capacitor discharge ignition circuit or system 11 including the capability of preventing overspeed operation of an associated engine (not shown).

The ignition system 11 includes a charge capacitor 13 including opposed plates 15 and 17.

The ignition system 11 also includes means comprising a relatively rotatable magnet 19 and coil 21 for generating alternating potential in response to relative rotation therebetween. While other arrangements are possible, it is preferred to rotate the magnet 19 at engine speed past the coil 21. The means for generating alternating potential is connected to the charge capacitor 13 for charging thereof by rectifying means which, in the illustrated construction, comprises a full wave rectifying bridge 23 having negative and positive terminals 25 and 27 respectively connected by leads 29 and 31 to the opposed plates 15 and 17 of the capacitor 13 and third and fourth terminals 33 and 35 respectively connected by leads 37 and 39 to the opposite ends of the charge coil 21.

The lead 29 extending between the rectifying bridge negative terminal 25 and the capacitor plate 15 includes a diode 41 having a cathode 43 connected to the rectifier terminal 25 and an annode 45 connected to the capacitor plate 15.

Also included in the ignition system 11 is a charge regulating means in the form of an SCR 51 having an annode 53 connected to the rectifier positive terminal 27, and a cathode 55 connected to the rectifier negative terminal 25, and a gate 57 connected to two series connected zenor diodes 61 and 63 which are arranged as shown and which are connected to the lead 31 between the positive terminal 27 of the rectifying means 23 and the capacitor plate 17.

The plate 17 of the capacitor 13 is connected to ground 71 while the other plate 15 of the capacitor 13 is desirably connected through a lead 73 to a kill switch 75 which, in turn, is connected to ground 71. If desired, the lead 73 can include a resistor 77.

Also connected to the capacitor 13 are first and second discharge sub-circuits 81 and 83 each including an ignition coil or transformer 85 and a switch which, preferably, is in the form of an SCR 87 having an annode-cathode path and a gate 89. The first and second ignition sub-circuits 81 and 83 are connected in parallel, are generally identical and, accordingly, only the sub-circuit 81 will be further described.

The ignition coil 85 includes a primary winding 91 and a secondary winding 93. One of the ends of the secondary winding 93 is connected to one of the ends of the primary winding 91 and the other end of the secondary winding 93 is connected to a spark plug 95 which, in turn, is connected to ground 71. The annode-cathode path of the SCR 87 and the primary winding 91 are connected in series with the opposed plates 15 and 17 of the capacitor 11.

Means are provided for generating respective trigger signals and for applying such trigger signals to the SCR's 87 of the ignition sub-circuits 81 and 83 to discharge the capacitor 13 through the primary winding 91 and thereby to generate sparks at the spark plugs 95. While various arrangements can be employed, in the illustrated construction, such means comprises a trigger coil 97 and a trigger magnet 99 which is rotatable relative to the trigger coil 97 at engine speed. The trigger coil 97 is connected, at its ends, through a pair of resistors 101 and 103, to the gates 89 of the SCR's 87. If desired, a capacitor 105 and a diode 107 can be connected, as shown, in parallel with the gate-cathode path of each SCR 87.

The trigger magnet 99 and trigger coil 97 are operative to generate two signals per revolution with one of the signals being applied to trigger one of the SCR's 87 and with the other signal being applied to trigger the other SCR 87.

The foregoing construction is believed to be well known in the art and various modifications thereof are well within the scope of the invention.

The circuit also includes a speed-limiting sub-circuit 111 comprising a switch 113 operative to ground the capacitor plate 15 and therefore prevent charging of the capacitor 13 in response to the application of a trigger or grounding signal, together with circuit means for generating a grounding signal applicable to trigger the switch 113, which grounding signal generation means includes a transformer 115 connected to the means for generating alternating potential and is operable in response to rotation above a predetermined speed of said relatively rotatable magnet and coil means for generating alternating potential. More specifically, the switch 113 comprises an SCR having an annode 117 connected to ground 71 and a cathode 119 connected to the lead 73 which connects with the capacitor plate 15. In addition, the switch or SCR 113 includes a gate or control element 121.

The transformer 115 comprises primary and secondary coils 123 and 125 with the primary coil 123 being included in the lead 39 extending between the rectifier terminal 35 and the charge coil 21. The secondary coil 125 is connected to a filter 131 which, in turn, is connected to the SCR gate 121. More specifically, the filter 131 includes a first capacitor 133 including opposed plates 135 and 137, with the plate 135 being connected by a lead 139 to one end of the secondary coil 125, together with a second capacitor 143 including opposed plates 145 and 147, with the plate 145 being connected by a lead 149 to the other end of the secondary coil 125, and an inductor 151 which is connected between the plate 137 of the first capacitor 133 and the plate 145 of the second capacitor 143. Preferably, another capacitor 153 is connected across the inductor 151. It is also desirable to include a resistor 155 connected between the plate 137 of the first capacitor 133 and the plate 147 of the second capacitor 143. In turn, the plate 137 of the first capacitor 133 is also connected to the SCR cathode 119 and the plate 147 of the second capacitor 143 is connected through a lead 159 to the SCR gate 121. Thus, there is provided a modified high pass filter which provides a specific control frequency relative to the predetermined speed at which capacitor charging is to be interrupted.

It is also desirable to employ means for regulating the voltage of the secondary coil 125 so as to provide a stable input for the filter 131. In the illustrated construction, such means comprises a pair of series conducted cathode-to-cathode zenor diodes 161 and 163 which are connected across the secondary coil 125 between the leads 139 and 149.

Because of manufacturing variation and tolerances in the parameters of the filter components, it is also desirable to include, in the lead 159 extending between the capacitor plate 147 and the SCR gate 121, a resistor 171 and a zenor diode 173. More particularly, one end of the resistor 171 is connected to the capacitor plate 147 and to the resistor 155 and the other end of the resistor 171 is connected to the cathode of the zenor diode 173. In turn, the annode of the zenor diode 173 is connected to the SCR gate 121.

In the preferred construction, the relatively rotatable magnet and coil means which charges the capacitor 13 preferably includes six separate magnets and can include two series connected coils. Of course, the parameters of the components of the speed-limiting sub-circuit will be chosen in accordance with the pulse frequency applied to the transformer 115.

In operation, whenever engine RPM exceeds a predetermined level, the speed-limiting sub-circuit and particularly the transformer 115 thereof, generates through the filter 131 a signal which turns on the switch or SCR 113 so as to kill the ignition circuit by, in effect, grounding the charge capacitor 13.

Various of the features of the invention are set forth in the following claims.

I claim:

1. A capacitor discharge ignition system with speedlimiting capability, said system comprising a charge capacitor, first relatively rotatable magnet and coil means for generating alternating potential, means connected between said means for generating alternating potential and said capacitor for applying said potential to charge said capacitor, second relatively rotatable magnet and coil means for generating potential, first switch means connected to said capacitor for discharging said capacitor to generate a spark in response to the application thereto of a first trigger signal generated by said second relatively rotatable magnet and coil means, second switch means connected to said capacitor for preventing charging of said capacitor in response to the application of a second trigger signal, and a signal generating circuit connected to said second switch means and to said first relatively rotatable magnet and coil means and operative to generate said second trigger signal in response to rotation above a predetermined speed of said first relatively rotatable magnet and coil means, said second signal generating circuit including a transformer connected to said first relatively rotatable magnet and coil means.

2. A capacitor discharge ignition system in accordance with claim 1 wherein said capacitor includes opposed first and second plates, wherein said first plate is grounded, wherein said transformer includes a primary coil connected to said first relatively rotatable magnet and coil means, said transformer also including a secondary coil, wherein said second switch means comprises an SCR having a gate, an annode connected to ground, and a cathode connected to said second plate of said capacitor, and wherein said signal generating circuit further includes a filter connected between said secondary coil and said gate of said SCR.

3. A capacitor discharge ignition system with speed-limiting capability, said system comprising a charge capacitor including opposed first and second plates with said first plate being grounded, relatively rotatable magnet and coil means for generating alternating potential, means connected between said means for generating alternating potential and said capacitor for rectifying said alternating potential to a potential of one polarity and for applying said potential of one polarity to charge said capacitor, first switch means connected to said capacitor for discharging said capacitor to generate a spark in response to the application of a first trigger signal, second switch means connected to said capacitor for preventing charging of said capacitor in response to the application of a second trigger signal above a predetermined potential, said second switch means comprising an SCR having a gate, an annode connected to ground, and a cathode connected to said second plate of said capacitor, and a signal generating circuit connected to said second switch means and operative to generate said second trigger signal in response to rotation above a predetermined speed of said means for generating alternating potential, said second signal generating circuit including a transformer including a primary coil connected to said means for generating alternating current, said transformer also including a secondary coil including opposed first and second ends, said second signal generating circuit further including a filter connected between said secondary coil and said gate of said SCR, and including a first capacitor including a first plate connected to said first end of said secondary coil, and a second plate connected to said SCR cathode, a second capacitor including a first plate connected to said second end of said secondary coil and a second plate connected to said SCR gate, and an inductor connected between said second plate of said first capacitor and said first plate of said second capacitor.

4. A capacitor discharge ignition system in accordance with claim 3 wherein said filter further includes another capacitor connected across said inductor.

5. A capacitor discharge ignition system in accordance with claim 3 wherein said filter further includes a resistor connected between said second plate of said first capacitor and said second plate of said second capacitor.

6. A capacitor discharge ignition system in accordance with claim 3 wherein said second plate of said second capacitor is connected to said gate by a lead including, in series, a resistor and a zenor diode.

7. A capacitor discharge ignition system in accordance with claim 6 wherein said zenor diode includes an annode connected to said gate and a cathode connected to said resistor.

8. A capacitor discharge ignition system with speed-limiting capability, said system comprising a charge capacitor including opposed first and second plates with said first plate being grounded, relatively rotatable magnet and coil means for generating alternating potential, means connected between said means for generating alternating potential and said capacitor for rectifying said alternating potential to a potential of one polarity and for applying said potential of one polarity to charge said capacitor, first switch means connected to said capacitor for discharging said capacitor to generate a spark in response to the application of a first trigger signal, second switch means connected to said capacitor for preventing charging of said capacitor in response to the application of a second trigger signal above a predetermined potential, said second switch means comprising an SCR having a gate, an annode connected to ground, and a cathode connected to said second plate of said capacitor, and a signal generating circuit connected to said second switch means and operative to generate said second trigger signal in response to rotation above a predetermined speed of said means for generating alternating potential, said second signal generating circuit including a transformer including a primary coil connected to said means for generating alternating current, said transformer also including a secondary coil, said second signal generating circuit further including a filter connected between said secondary coil and said gate of said SCR, and means for regulating the output of said secondary coil including a pair of cathode-to-cathode series connected, zenor diodes connected across said secondary coil.

9. A capacitor discharge ignition system in accordance with claim 1 wherein said rectifying means includes a positive and a negative terminal and further including charge regulating means including an SCR having an annode connected to said positive terminal, and a cathode connected to said negative terminal, and a gate, and a pair of series connected zenor diodes connected to said gate and to said positive terminal of said rectifying means.

10. A capacitor discharge ignition system in accordance with claim 2 wherein said secondary coil includes opposed first and second ends, wherein said filter includes a first capacitor including a first plate connected to said first end of said secondary coil, and a second plate connected to said SCR cathode, a second capacitor including a first plate connected to said second end of said secondary coil and a second plate connected to said SCR gate, and an inductor connected between said second plate of said first capacitor and said first plate of said second capacitor.

11. A capacitor discharge ignition system in accordance with claim 10 wherein said filter further includes another capacitor connected across said inductor.

12. A capacitor discharge ignition system in accordance with claim 10 wherein said filter further includes a resistor connected between said second plate of said first capacitor and said second plate of said second capacitor.

13. A capacitor discharge ignition system in accordance with claim 10 wherein said second plate of said second capacitor is connected to said gate by a lead including, in series, a resistor and a zenor diode.

14. A capacitor discharge ignition system in accordance with claim 13 wherein said zenor diode includes an annode connected to said gate and a cathode connected to said resistor.

15. A capacitor discharge ignition system in accordance with claim 2 and further including means for regulating the output of said secondary coil including a pair of cathode-to-cathode series connected, zenor diodes connected across said secondary coil.

* * * * *